US008517468B2

(12) United States Patent
Scott-Groveveldt

(10) Patent No.: US 8,517,468 B2
(45) Date of Patent: Aug. 27, 2013

(54) CUSHIONED BED CHAIR

(76) Inventor: Sheena Scott-Groveveldt, Bronx, NY (US)

( * ) Notice: Subject to any disclaimer, the term of this patent is extended or adjusted under 35 U.S.C. 154(b) by 0 days.

(21) Appl. No.: 13/186,403

(22) Filed: Jul. 19, 2011

(65) Prior Publication Data

US 2013/0020839 A1 Jan. 24, 2013

(51) Int. Cl.

| | |
|---|---|
| ***A47D 1/10*** | (2006.01) |
| ***A47C 31/00*** | (2006.01) |
| ***A47C 21/00*** | (2006.01) |

(52) U.S. Cl.

USPC ..... 297/250.1; 297/217.3; 5/503.1

(58) Field of Classification Search

USPC ..... 297/250.1, 217.7, 217.1, 252, 217.3, 297/DIG. 1, 51, 378.1; 5/2.1, 632, 507.1, 5/503.1; 601/49, 86, 90, 91, 98

See application file for complete search history.

(56) References Cited

U.S. PATENT DOCUMENTS

| | | | | | |
|---|---|---|---|---|---|
| 2,127,442 | A * | 8/1938 | Dowdy | 297/47 |
| 2,529,350 | A * | 11/1950 | Posz | 5/633 |
| 2,802,220 | A * | 8/1957 | Locke | 5/633 |
| 2,867,821 | A * | 1/1959 | Bolton | 5/632 |
| 3,167,790 | A * | 2/1965 | Hickey | 5/507.1 |
| 3,335,434 | A * | 8/1967 | Gamon | 297/153 |
| 3,904,242 | A * | 9/1975 | Koepke et al. | 297/452.6 |
| 4,522,447 | A * | 6/1985 | Snyder et al. | 297/452.27 |
| 4,951,334 | A * | 8/1990 | Maier | 5/653 |
| 4,960,304 | A * | 10/1990 | Frantz | 297/284.6 |
| 4,981,131 | A * | 1/1991 | Hazard | 601/24 |
| 5,044,690 | A * | 9/1991 | Torrey | 297/16.1 |
| 5,713,832 | A * | 2/1998 | Jain | 601/49 |
| 6,611,980 | B2 * | 9/2003 | Wempe | 5/654 |
| 2005/0146195 | A1 * | 7/2005 | Machael et al. | 297/452.41 |
| 2005/0216061 | A1 * | 9/2005 | Kim et al. | 606/237 |
| 2006/0175883 | A1 * | 8/2006 | Neustat | 297/229 |

* cited by examiner

*Primary Examiner* — Milton Nelson, Jr.
(74) *Attorney, Agent, or Firm* — Jerry D. Haynes; Law Office of Jerry D. Haynes

(57) ABSTRACT

A cushioned bed chair attached to a bed that includes a vertical support with an inside portion to provide vertical support to a user, a horizontal support with a bottom surface, a distal end and an inside portion secured in a perpendicular position to the vertical support when the user is sitting in the bed chair and a pair of support legs attached to the bottom surface and distal end of the horizontal support. The bed chair also includes a plurality of polyurethane foam pads disposed on the inside portion of the horizontal support and the inside portion of the vertical support to provide comfort to the user sitting on the bed chair and a control dial that controls a massage unit disposed on the vertical support that provides a massaging action on the user.

3 Claims, 1 Drawing Sheet

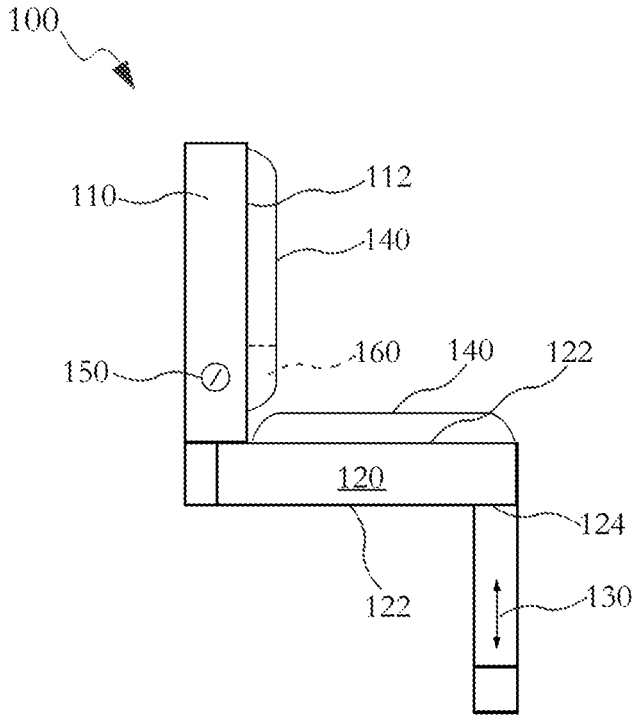
100
110
112
140
150
160
140
122
120
124
122
130

CUSHIONED BED CHAIR

TECHNICAL FIELD & BACKGROUND

Traditional bed chairs provide padding that is designed to be situated against a headboard or a wall, which can be inconvenient due to its lack of mobility and stationary function. The currently there are limited alternatives to bed chairs that avoid inadequate padding, aches, pains, or soreness, particularly for anyone who has had an injury in the upper or lower extremities.

The present invention generally relates to a bed chair. More specifically, the invention is a cushioned bed chair attached to a side or end of a bed.

It is an object of the invention to provide a cushioned bed chair for the therapeutic industry attached to a side or end of a patient's bed.

It is an object of the invention to provide a cushioned bed chair for a user to comfortably utilize a computer near a side or an end of a patient's bed.

What's really needed is a cushioned bed chair for the therapeutic industry attached to a side of a patient's bed that can also be utilized by a user to comfortably utilize a computer near a side or an end of a patient's bed.

BRIEF DESCRIPTION OF THE DRAWINGS

The present invention will be described by way of exemplary embodiments, but not limitations, illustrated in the accompanying drawings in which like references denote similar elements, and in which:

FIG. 1 illustrates a side perspective view of a cushioned bed chair, in accordance with one embodiment of the present invention.

DETAILED DESCRIPTION OF ILLUSTRATIVE EMBODIMENTS

Various aspects of the illustrative embodiments will be described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations are set forth in order to provide a thorough understanding of the illustrative embodiments. However, it will be apparent to one skilled in the art that the present invention may be practiced without the specific details. In other instances, well-known features are omitted or simplified in order not to obscure the illustrative embodiments.

Various operations will be described as multiple discrete operations, in turn, in a manner that is most helpful in understanding the present invention. However, the order of description should not be construed as to imply that these operations are necessarily order dependent. In particular, these operations need not be performed in the order of presentation.

The phrase "in one embodiment" is utilized repeatedly. The phrase generally does not refer to the same embodiment, however, it may. The terms "comprising", "having" and "including" are synonymous, unless the context dictates otherwise.

FIG. 1 illustrates a side perspective view of a cushioned bed chair 100, in accordance with one embodiment of the present invention. The cushioned bed chair 100 can be attached to a side or an end of a bed to provide a relatively comfortable seat to a user who desired to sit next to a bed.

The cushioned bed chair 100 includes a vertical support 110, a horizontal support 120, a plurality of support legs 130, a plurality of pads 140, a control dial 150 and a massage unit 160. The cushioned bed chair 100 is made of materials selected from the group of plastic, aluminum, vinyl and rubber. The cushioned bed chair 100 is relatively lightweight and weighs in the range of approximately 2 to 3 pounds.

The vertical support 110 is secured in a perpendicular position to the horizontal support 120 while the horizontal support 120 is directly sat on by a user. The vertical support 110 can be swung and folded towards the horizontal support 120 when being stored. The support legs 130 are disposed on the bottom surface 122 distal end 124 of the horizontal support 120 and are typically two support legs, although any suitable number of horizontal support legs can be utilized. The support legs 130 can also be swung and folded inward towards the bottom surface 122 when the cushioned bed chair is being stored. The pads 140 are disposed on the inside portion 112 of the vertical support 110 and the inside portion 122 of the horizontal support 120 to provide added comfort to the user sitting on the cushioned bed chair 100. The pads 140 are high density foam pads which conform to the contours of the seated user to provide support for the spine and eliminate stress on the user's back and hips. The pads 140 are made of polyurethane foam padding, although the pads 140 can be made of other suitable materials to provide comfort to the user while sitting on the cushioned bed chair 100. The pads 140 are approximately 18 inches wide and 12 inches high, although the pads 140 can be other suitable dimensions. The control dial 150 is an optional feature of the cushioned bed chair 100 that controls a massage unit 160 disposed on the vertical support 110 to massage a lower lumbar region of the user or other suitable region of the user. The control dial 150 controls the relative amount of a massaging action, such as vibration, of the massage unit 160 or other suitable massaging action.

The cushioned bed chair is a foldable chair that is specifically designed to be used at an end or a side of the bed, ensuring accessibility and convenience in any sized room. By providing a cushioned seat with two front legs that are placed over the edge of a bed, the cushioned bed chair functions like a conventional chair but with the added benefit of no back legs and a supportive, padded seating surface for use at a computer. The cushioned bed chair utilizes high density foam padding which conforms to the contours of the seated individual to provide support for the user's spine and eliminate stress on the user's back and hips. Additional features of the cushioned bed chair include easy storage options for optimum versatility and ease of use, making it well-suited for small bedrooms or closets.

The cushioned bed chair features high density polyurethane foam, allowing air to pass through open cells with greater ease for recuperative, comfortable padding. The design of the cushioned bed chair will come with an installed massage unit in upgraded versions and will also be available in various colors and sizes.

While the present invention has been related in terms of the foregoing embodiments, those skilled in the art will recognize that the invention is not limited to the embodiments described. The present invention can be practiced with modification and alteration within the spirit and scope of the appended claims. Thus, the description is to be regarded as illustrative instead of restrictive on the present invention.

What is claimed is:

1. A plastic cushioned bed chair comprising:

a vertical support with an inside portion to provide vertical support;

a horizontal support with a bottom surface, a distal end and an inside portion secured in a perpendicular position to said vertical support when sitting in said bed chair;

a pair of support legs attached to said bottom surface and distal end of said horizontal support;

a plurality of high density polyurethane foam pads disposed on said inside portion of said horizontal support and said inside portion of said vertical support to provide comfort when sitting on said bed chair; and a control dial incorporated into said vertical support that controls a massage unit disposed on said vertical support; where said massage unit massages a lower lumbar region.

2. The bed chair according to claim 1, wherein said vertical support is swung and folded towards said horizontal support when said bed chair is stored.

3. The bed chair according to claim 1, wherein said support legs are swung and folded inward towards said bottom surface when said bed chair is stored.

* * * * *